US012312142B2

(12) United States Patent
Schikurski et al.

(10) Patent No.: US 12,312,142 B2
(45) Date of Patent: May 27, 2025

(54) TOUCHLESS PACKAGE

(71) Applicant: AGILENT TECHNOLOGIES, INC., Santa Clara, CA (US)

(72) Inventors: Olga Schikurski, Baden-Wuerttemberg (DE); Lucas Serge, Wilmington, DE (US); Qi Siegmundt-Pan, Karlsruhe (DE); Michael Wherry, Santa Clara, CA (US); Thorsten Dressler, Mannheim (DE); Daniela Loraing, Karlsruhe (DE); Thomas Dumoulin, Strasbourg (FR)

(73) Assignee: AGILENT TECHNOLOGIES, INC., Santa Clara, CA (US)

( * ) Notice: Subject to any disclaimer, the term of this patent is extended or adjusted under 35 U.S.C. 154(b) by 18 days.

(21) Appl. No.: 17/680,170

(22) Filed: Feb. 24, 2022

(65) Prior Publication Data

US 2022/0274757 A1 Sep. 1, 2022

Related U.S. Application Data

(60) Provisional application No. 63/154,416, filed on Feb. 26, 2021.

(51) Int. Cl.

| | |
|---|---|
| ***B65D 75/36*** | (2006.01) |
| ***B65D 43/16*** | (2006.01) |
| ***B65D 43/20*** | (2006.01) |
| ***B65D 75/52*** | (2006.01) |

(52) U.S. Cl.

CPC ..... *B65D 75/367* (2013.01); *B65D 43/162* (2013.01); *B65D 43/20* (2013.01); *B65D 75/527* (2013.01)

(58) Field of Classification Search

CPC .... B65D 75/367; B65D 43/162; B65D 43/20; B65D 75/527; B65D 75/366; B65D 2543/00462

USPC ..... 206/465, 464, 468, 349–383, 704, 206/528–540; 220/812

See application file for complete search history.

(56) References Cited

U.S. PATENT DOCUMENTS

| | | | | |
|---|---|---|---|---|
| 2,105,424 A * | 1/1938 | Kahn | A45C 11/34 206/214 |
| 2,502,311 A | 3/1950 | Clarke | |
| 3,136,413 A | 6/1964 | Hall | |
| 3,157,280 A * | 11/1964 | Perdue | B65D 75/366 D9/415 |
| 3,187,926 A * | 6/1965 | Zimmet | A47K 5/02 220/345.3 |

(Continued)

FOREIGN PATENT DOCUMENTS

| | | |
|---|---|---|
| CN | 104755391 B | 3/2017 |
| EP | 1357050 B1 | 10/2003 |

(Continued)

OTHER PUBLICATIONS

Search report on DE Application No. DE102022104611.7, mailed date Dec. 1, 2022, 7 pages.

*Primary Examiner* — Chun Hoi Cheung

(57) ABSTRACT

A package (100), including a base (150) having at least one receptacle (151), in which the at least one receptacle (151) includes a first portion (154) having a first diameter (D1) and a second portion (152) having a bottom surface and a second diameter (D2) is disclosed. A method for removing a product from the package is also disclosed.

12 Claims, 9 Drawing Sheets

(56) References Cited

U.S. PATENT DOCUMENTS

| | | | | |
|---|---|---|---|---|
| 3,331,497 | A | 7/1967 | Lunsford | |
| 3,381,808 | A | 5/1968 | McGraw, II | |
| 3,469,686 | A | 9/1969 | Gutsche et al. | |
| 3,515,268 | A * | 6/1970 | Lindberg | B65D 75/54 206/232 |
| 3,741,377 | A | 6/1973 | Krellen | |
| 3,812,963 | A * | 5/1974 | Zahuranec | B65D 75/366 220/345.3 |
| 3,896,967 | A | 7/1975 | Doolittle | |
| D238,250 | S | 12/1975 | William, Jr. | |
| 4,535,890 | A * | 8/1985 | Artusi | A61J 1/16 220/345.2 |
| 4,574,954 | A | 3/1986 | Reid | |
| 4,722,440 | A * | 2/1988 | Johnston | B65D 71/70 206/319 |
| 4,998,623 | A | 3/1991 | Doull | |
| 5,074,418 | A * | 12/1991 | Buan | B65D 43/162 206/525 |
| D331,009 | S | 11/1992 | Dahl | |
| 5,577,629 | A * | 11/1996 | Rosler | B25H 3/023 220/345.3 |
| 5,620,088 | A | 4/1997 | Martin | |
| 5,944,177 | A * | 8/1999 | Nemoto | B65D 75/54 206/468 |
| 6,588,180 | B2 * | 7/2003 | Heath | B65B 47/04 425/398 |
| D518,737 | S | 4/2006 | Zalzal | |
| 7,210,580 | B2 | 5/2007 | Elliott | |
| D559,706 | S | 1/2008 | Clements | |
| D593,325 | S | 6/2009 | Evans | |
| 7,628,292 | B2 | 12/2009 | Lancesseur et al. | |
| D607,749 | S | 1/2010 | Freeland et al. | |
| D607,750 | S | 1/2010 | Freeland et al. | |
| D607,751 | S | 1/2010 | Freeland et al. | |
| D607,752 | S | 1/2010 | Freeland et al. | |
| 7,644,822 | B2 | 1/2010 | Elliott | |
| 7,784,250 | B2 | 8/2010 | Grosskopf | |
| 8,679,404 | B2 * | 3/2014 | Liburd | B65D 77/20 206/439 |
| D711,253 | S | 8/2014 | Rathbone et al. | |
| 9,138,378 | B2 | 9/2015 | McArthur et al. | |
| D763,104 | S | 8/2016 | Akana | |
| 9,475,187 | B2 * | 10/2016 | Grinwald | B65D 75/321 |
| 9,573,746 | B2 * | 2/2017 | Rud | B65D 65/38 |
| 9,586,748 | B2 | 3/2017 | Le | |
| 9,914,568 | B2 * | 3/2018 | Rud | B65D 25/22 |
| 10,450,126 | B2 | 10/2019 | Branyon et al. | |
| D886,638 | S | 6/2020 | Bhalla et al. | |
| D898,526 | S | 10/2020 | Delgado Carmona | |
| D902,054 | S | 11/2020 | Bhalla et al. | |
| D905,574 | S | 12/2020 | Flanagan | |
| 10,864,315 | B2 | 12/2020 | Fox et al. | |
| 2002/0108878 | A1 * | 8/2002 | Mickel | B65D 75/366 206/464 |
| 2006/0076259 | A1 * | 4/2006 | Browder | B65D 5/52 206/471 |
| 2014/0331618 | A1 * | 11/2014 | Guggisberg | B65B 7/2807 53/287 |
| 2015/0239640 | A1 | 8/2015 | Smith | |
| 2015/0284174 | A1 | 10/2015 | Vogels et al. | |
| 2019/0117328 | A1 | 4/2019 | Chase | |
| 2019/0218015 | A1 | 7/2019 | Tojo et al. | |
| 2019/0329952 | A1 | 10/2019 | Khouri | |
| 2020/0240068 | A1 | 7/2020 | Sanders | |
| 2021/0315118 | A1 * | 10/2021 | Shimizu | H05K 5/03 |

FOREIGN PATENT DOCUMENTS

| | | | |
|---|---|---|---|
| EP | 2217195 | A1 | 8/2010 |
| EP | 2911951 | B1 | 11/2016 |
| GB | 2451850 | B | 2/2009 |
| GB | 2496758 | A | 5/2013 |
| WO | 2005082745 | A1 | 9/2005 |
| WO | 2013089702 | A1 | 6/2013 |
| WO | 2020092338 | A1 | 5/2020 |

* cited by examiner

TOUCHLESS PACKAGE

RELATED APPLICATION

The present application claims priority to U.S. Provisional Application No. 63/154,416, filed Feb. 26, 2021, the entire disclosure of which is hereby incorporated by reference.

FIELD OF THE INVENTION

The present disclosure relates to a package, including a base having at least one receptacle, in which the at least one receptacle includes a first portion having a first diameter (D1) and a second portion having a bottom surface and a second diameter (D2) is disclosed. A method for removing a product from the package is also disclosed.

BACKGROUND

Frits and/or guard columns are widely utilized to provide a coarse filtration of the High Performance Liquid Chromatography (HPLC) eluent and prevent contaminant particles from reaching the HPLC system. Regular replacement of the frits and/or guard columns is necessary to help reduce system downtime, repair cost, and further extend the lifetime of the instrument. Currently, these frits and/or guard columns must be manually removed from a package by pinching a single frit and/or a guard column out of the package. In some applications, in order to avoid making direct contact with the frit, a user can wear gloves and use tweezers to remove the used frit and/or guard column and install a new frit and/or guard column into a fitting. Such actions are challenging and can result in contamination of the new frit and/or guard column.

Moreover, current packaging does not include features that guide the installation of the new frits and/or the guard columns into the fitting. Therefore, there is a need for a package that facilitates removal and installation of a product from the package in an efficient manner that minimizes contamination of the product.

SUMMARY OF THE INVENTION

In an aspect, a touchless package includes a base having at least one receptacle. The receptacle includes a first portion having a first diameter and a second portion having a closed bottom and a second diameter. The second diameter is different from the first diameter.

In another aspect, the first diameter is larger than the second diameter.

In a further aspect, the base includes a track corresponding to a first portion of a cover and at least one lock corresponding to a second portion of the cover.

In yet another aspect, the at least one lock is in a form of a recess, a protrusion, or an indexing mechanism.

In an aspect, the track is in a form of a slot, a rail, or an indexing mechanism.

In another aspect, the second portion of the cover is in a form of a protrusion, a recess, or an indexing mechanism.

In a further aspect, the touchless package further includes a cover, which, in an aspect, can include a top surface and a bottom surface. A portion of the top surface that comes in contact with a user includes a surface texture that is different from the rest of the top surface.

In yet another aspect, the surface texture is in a form of a plurality of slits, holes, protrusions, indentations, particles, or a combination thereof.

In an aspect, the surface texture creates a grip between the cover and the user, such that the grip force is sufficient to overcome a force created between the lock and the second portion of the cover.

In another aspect, the package further includes at least one peelable or breakable film cover that covers the at least one receptacle.

In a further aspect, the at least one receptacle includes a thickness such that a force applied to the receptacle to release a product creates a confirmation sound.

In yet another aspect, the at least one receptacle includes a ledge to removably secure a product inside the receptacle.

In an aspect, the package further includes an identifier.

In another aspect, the identifier is an RFID, a QR code, a pin, or a part number.

In a further aspect, a method for removing a product from a package includes inserting a fitting into a receiver portion of a receptacle such that a product stored in a container portion is aligned with an opening of the fitting, moving the product into the opening of the fitting without touching the product, and removing the fitting from the receiver portion of the receptacle.

In yet another aspect, inserting the fitting into the receiver portion of the receptacle includes removing a cover from the receptacle.

In an aspect, the cover is a peelable film, a breakable film, or a slidable cover.

In another aspect, moving the product into the opening of the fitting includes applying a force to the container portion of the receptacle.

In a further aspect, the force causes the container portion to at least partially or temporarily collapse.

In yet another aspect, the at least partial or temporarily collapse of the container provides a confirmation indicator that the product is correctly placed in the fitting.

Additional features and advantages of various embodiments will be set forth, in part, in the description that follows, and will, in part, be apparent from the description, or can be learned by the practice of various embodiments. The objectives and other advantages of various embodiments will be realized and attained by means of the elements and combinations particularly pointed out in the description herein.

DRAWINGS

The same part numbers designate the same or similar parts throughout the figures.

DESCRIPTION

The disclosure is directed to a package for a product, for example, a frit or a guard column, in which the package is configured to allow insertion and/or removal of a fitting into the package without contact of the product. By "without contact of the product" is meant that a user does not need to use their fingers or a tool, such as tweezers, in order to provide a new product to a fitting. This can reduce contamination risks of the product, and reduce the risks of the product falling out of the package by mistake during installation into a fitting. Additionally, the package can separately secure each product, of a plurality of products, in a receptacle of the packaging. The separation of each product can also allow for easier installation through guiding features, and easier installation in restricted spaces, for example, within narrow chromatographic modules. The package can be a touchless package in which a fitting can be inserted and/or removed from the package, and/or a product can be inserted and/or removed from the package without a person actually touching the product.

Figure 1:
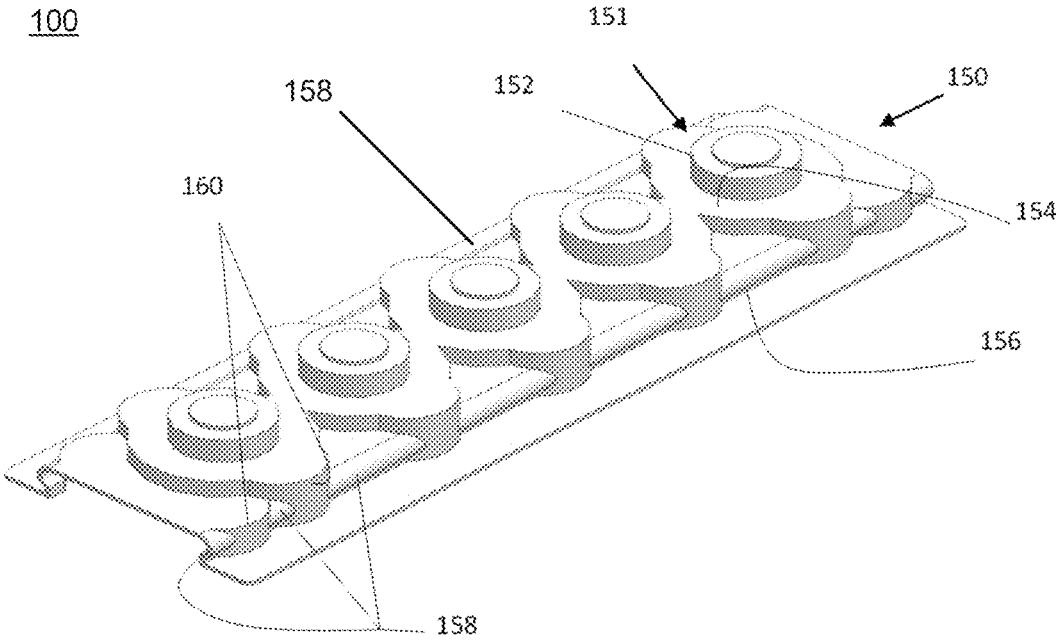
FIG. 1 is a bottom perspective view of a base of the package, according to an aspect of the invention.

As shown in FIG. 1, there is disclosed a package 100 including a base 150. The base 150 can include at least one receptacle 151, such as a plurality of receptacles, along a length of the base 150. In an aspect, the package 100 can include a base 150 with a single receptacle. In another aspect, the package 100 can include a base 150 with a plurality of receptacles 151 in which each receptacle 151, of the plurality of receptacles 151, is adjacent to one another so that each edge of a container portion 152 of one receptacle 151 interfaces with an edge of a container portion 152 of an adjacent receptacle 151. In another aspect, the package 100 can include a base 150 with a plurality of receptacles 151 in which each receptacle 151, of the plurality of receptacles 151, is close to one another so that a gap of base material is present between each edge of a container portion 152 of one receptacle 151 and an edge of a container portion 152 of an adjacent receptacle 151. In a further aspect, the package 100 can include a base 150 with a plurality of receptacles 151 in which the base 150 includes weakened sections positioned in a gap of base material located between each receptacle 151. Each receptacle 151 can include a container portion 152 and a receiver portion 154, which are more fully disclosed herein.

The base 150 can be made of a polymeric material, paper, aluminum, aluminum containing material, glass, metal, or combinations thereof. In an aspect, the base 150, including the at least one receptacle 151 can be formed of a deformable material. In an example, the base 150 can be made of polyethylene terephthalate (PET).

Figure 2:
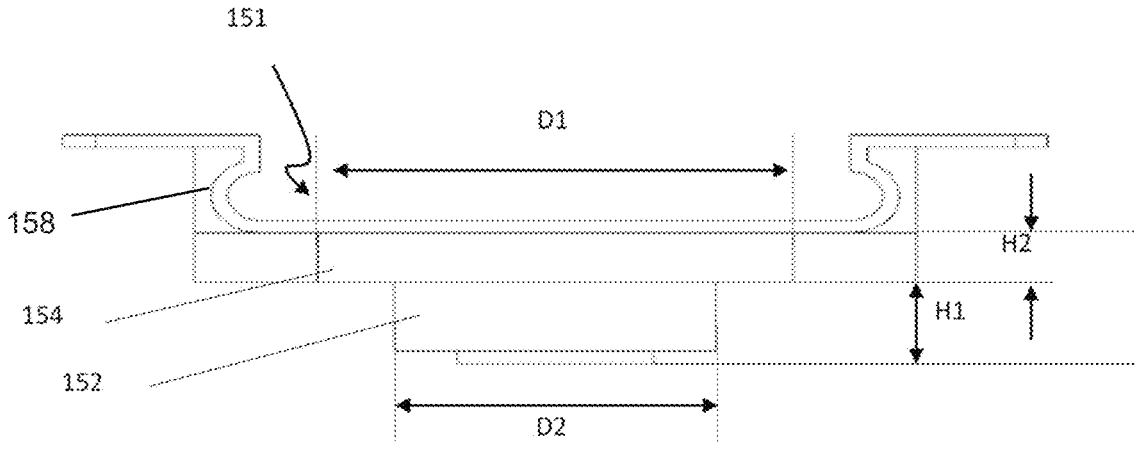
FIG. 2 is a cross-sectional view of the base of FIG. 1, showing a receptacle having a first diameter of a receiver portion and a second diameter of a container portion.
Figure 3:
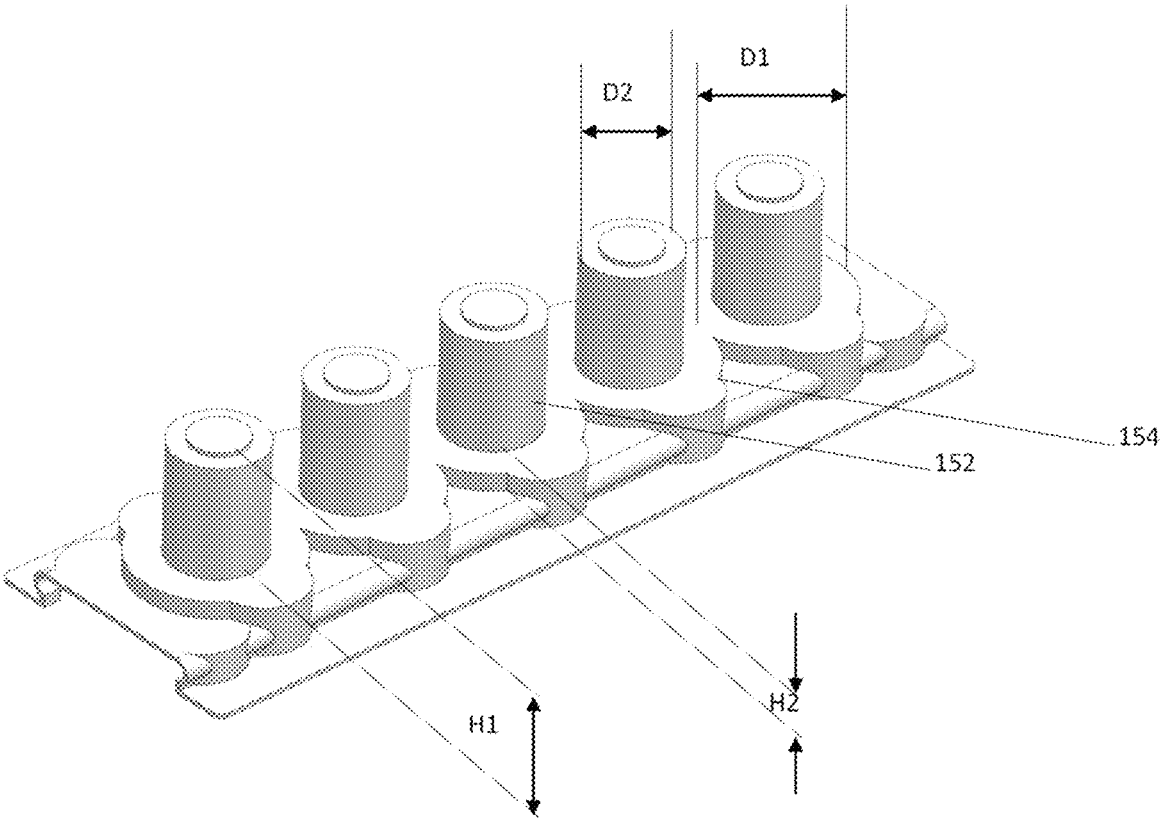
FIG. 3 is a bottom perspective view of a base, according to another aspect of the invention.
Figure 15:
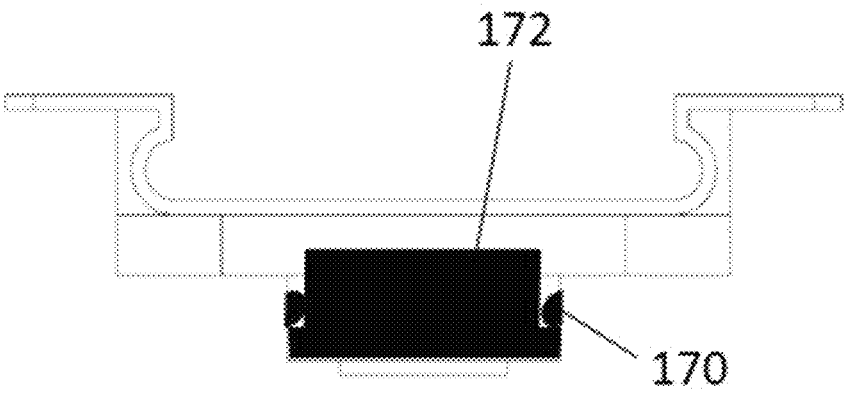
FIG. 15 is a cross-sectional view of FIG. 14, showing a product secured by the ledges in the receptacle, according to an example.

The container portion 152 can be configured and dimensioned to receive a product 172 in need of packaging, as shown in FIG. 15. As shown in FIG. 2, the container portion 152 can include a second diameter D2 and a first height H1. The second diameter D2 and the first height H1 can vary depending upon the dimensions of the product 172. For example, the container portion 152 of FIG. 1 has a shallow first height H1 as compared to the container portion 152 of FIG. 3, which has a relatively increased first height H1.

The receiver portion 154 can be configured and dimensioned to fit around or receive an opening of a fitting 190 into which the product 172 can be inserted. As shown in FIG. 2, the receiver portion 154 can include a first diameter D1 and a second height H2. The first diameter D1 and the second height H2 can vary depending upon the dimensions of the fitting 190. In an aspect, the first diameter D1 can be different, such as larger, than the second diameter D2. In this manner, the receiver portion 154 can fit around a fitting 190 that receives a frit or a guard cartridge assembly.

The height H1 and the height H2 can be the same or different. For example, as shown in FIG. 2, the height H1 can be longer than the height H2. For example, when the container portion 152 includes a guard column, the height H1 can be longer than the height H2.

The second diameter D2 can be different from the first diameter D1. In an aspect, the second diameter D2 can be about the same or slightly smaller than a diameter of a product 172. In this manner, at least a portion of the product 172 can friction fit into the container portion 152, and can, for example, avoid accidentally dropping out of the package 100. In another aspect, the second diameter D2 can be larger than a diameter of the product 172 so that an applied force, such as gravity, can overcome any friction between the walls of the container portion 152 and the sides of the product 172. In an example, the first diameter D1 can be substantially the same or slightly larger than a diameter of a fitting 190 so that the receiver portion 154 can receive the fitting 190 and install the product 172 into an opening of the fitting 190 without a user or tools touching the product 172.

Figure 4:
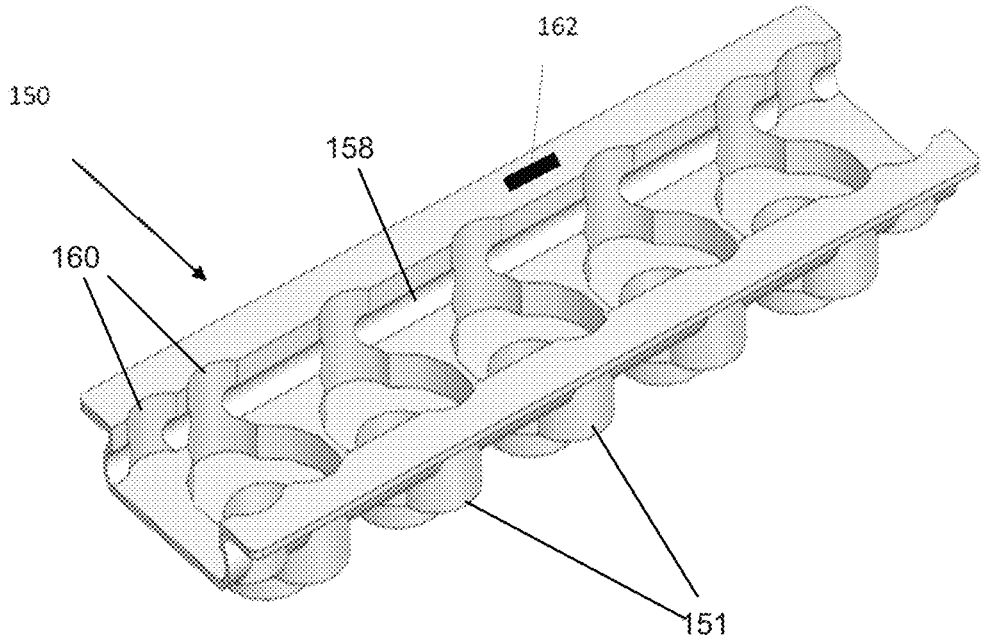
FIG. 4 is a top perspective view of the base illustrating an identifier, according to an aspect of the invention.

The base 150 can include an identifier 162, as shown in FIG. 4. In another aspect, the cover 110 can include an identifier 162. The identifier 162 can be chosen from an RFID, a QR code, a pin, a word, a color, a symbol, an alphanumeric, an indicium, or a part number. The identifier 162 can further include information, such as manufacturing origin, type of product 172 in the container portion 152, batch number, etc.

Figure 5:
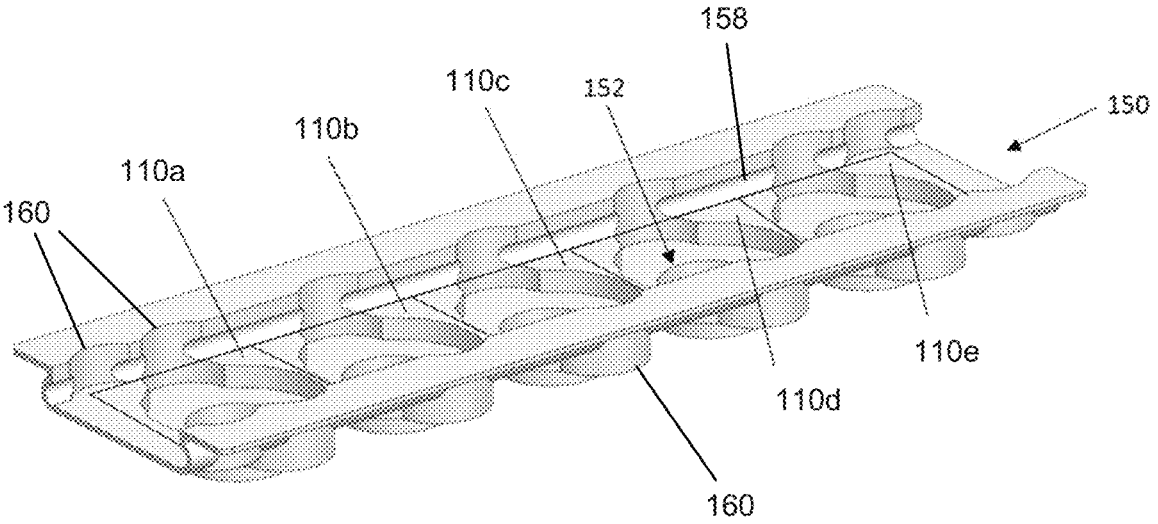
FIG. 5 is a top perspective view of a base having a plurality of covers, according to an aspect of the invention.

As shown in FIGS. 1, 4, and 5, the base 150 can include side walls 156, which can further include a track 158 and/or at least one lock 160. The track 158 can extend along at least a portion of a length of the side wall of the base 150. The track 158 can also extend along an edge of at least one receptacle 151. The base 150 can include a track 158 on each side wall 156. The track 158 can be dimensioned and configured to receive a cover 110. As will be explained in more detail below, the cover 110 can include a first portion 112 that can engage with the track 158. The track 158 can be in a form of a recess, a protrusion, a slot, a rail, an indexing mechanism, or, etc. As shown in FIG. 1, the base 150 includes two tracks 158, one on each side wall 156. Each track 158 can extend an entire length of the base, and can be tangent to an edge of each receiver portion 154. In this manner, each receptacle 151 is sandwiched between two tracks 158. In an aspect, the base 150 does not include a track 158.

As discussed above, the base 150 can also include at least one lock 160 positioned at one or more places along the track 158. The lock 160 can be dimensioned and configured to receive a cover 110. As will be explained in more detail below, the cover 110 can include a second portion 114 that can engage with the lock 160. The lock 160 can be in a form of a recess, a protrusion, a slot, a rail, an indexing mechanism, or, etc. A track 158 can include a first end including a first lock 160*a*, and a second end including a second lock 160*b*. In an aspect, a lock 160 can be positioned to correspond with an edge of a receptacle 151. For example, if the base 150 includes a plurality of receptacles 151, then a lock 160 can be positioned to correspond with an edge of each receptacle 151 of the plurality of receptacles, as shown in FIGS. 4 and 5. In an aspect, the base 150 does not include a lock 160. In this manner, the base 150 can friction fit with the cover 110.

Figure 14:
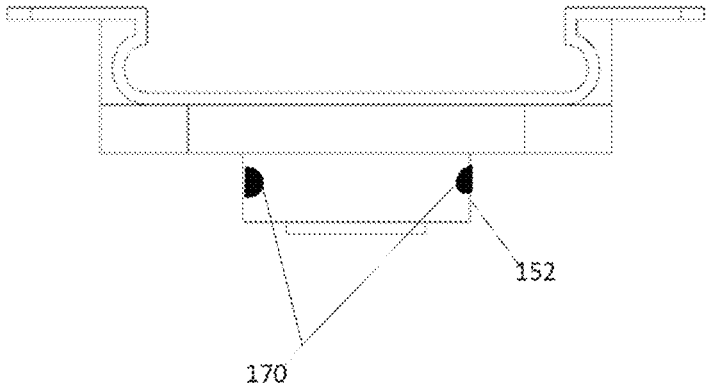
FIG. 14 is a cross-sectional view of the base of FIG. 1, showing ledges in a receptacle, according to an example.

Referring to FIGS. 14 and 15, the container portion 152 of the at least one receptacle 151 can include a ledge 170 that can secure a product 172, for example, a frit or a guard column, in the container portion 152. The ledge 170 can be in a form of one or more protrusions or can be in a form of a ring that spans a circumference of the container portion 152. In an aspect, the product 172 can be released by applying a force to the container portion 152 to overcome the friction fit created by the ledge 170. In an aspect, the container portion 152 does not include a ledge 170 and the product 172 can rest on a bottom surface of the container portion 152. In this manner, the product 172 can be released by applying a force, such as tilting or rotating the package 100 so that the product 172 is applied to a fitting 190.

The package 100 can further include at least one cover 110. The at least one cover 110 can be a single cover or a plurality of covers 110*a*, 110*b*, 110*c*, etc. The at least one cover 110 can be configured and dimensioned to span at least one opening in the base 150 created by the receptacle 151. In an aspect, the at least one cover 110 can span a single opening in the base 150 created by a single receptacle 151. In another aspect, the at least one cover 110 can span an entire length of the base 150. The at least one cover 110 can be a film, a seal, a hinged cover, or a slidable cover. The cover 110 can be made of a polymeric material, paper, aluminum, aluminum containing material, or combinations thereof.

Figure 6:
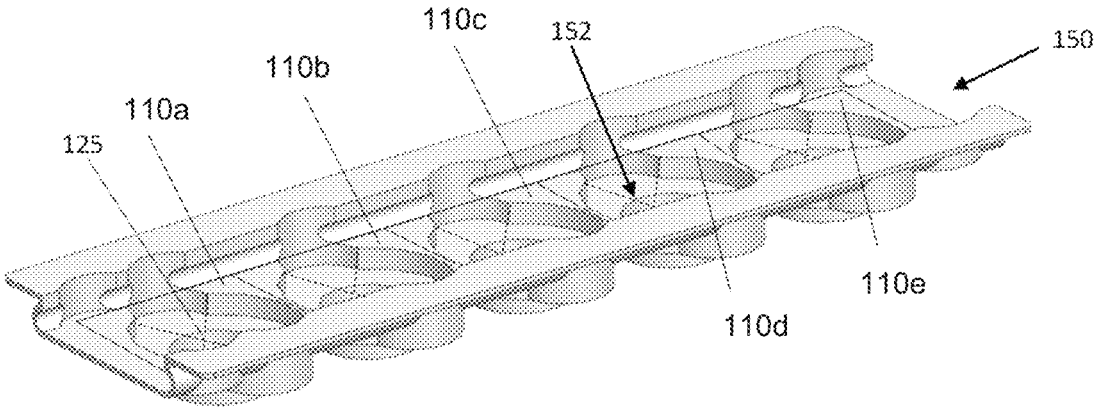
FIG. 6 is a top perspective view of a base having a plurality of covers with weakened sections, according to another aspect of the invention.

FIGS. 5 and 6 illustrate examples in which the at least one cover 110 can be a plurality of covers 110*a*-110*e*, in which each cover 110 of the plurality of covers 110 can span an opening in the base 150 corresponding to a single receptacle 151. Each cover 110 of the plurality of covers can be separated one from another by a weakened section 125 that can be positioned over a wall of base 150 adjoining two receptacles 151. In an aspect, each cover 110*a*-110*e* can be formed of a polymer film that can be peeled away from the base 150 to expose a single opening at a time. For example, the weakened section 125 can be a cut line or score line on the polymer film to assist in peeling away a single cover 110 at a time.

Figure 7:
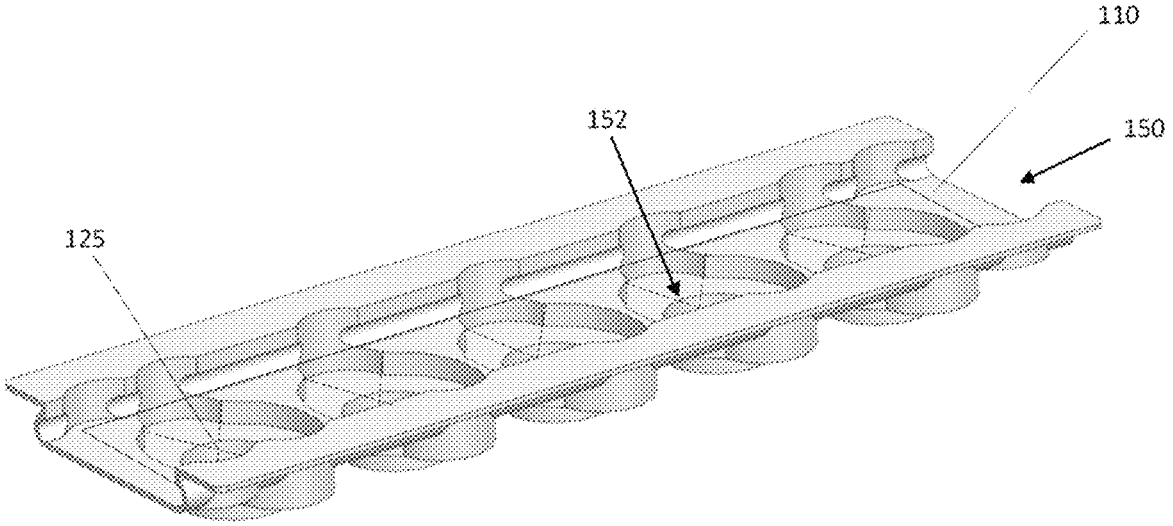
FIG. 7 is a top perspective view of a base having a single cover with a plurality of weakened sections, according to another aspect of the invention.

In another aspect, each cover 110 of the plurality of covers 110*a*-110*e* can include a weakened section 125 in a central position of the cover 110 and over the single receptacle 151, as shown in FIG. 6. In another aspect, as shown in FIG. 7, the cover 110 is a single cover that extends over a plurality of receptacles, and include a plurality of weakened sections 125, with each weakened section 125 in a central position over each receptacle 151. The weakened section 125 can tear when the receiver portion 154 is pressed to fit around a fitting 190. Once the receiver portion 154 is pressed onto the fitting, the container portion 152 having the product can be aligned with the opening of the fitting, thus, allowing the user to place a force on the bottom section of the container portion 152 to insert the product without touching it.

Figure 8:
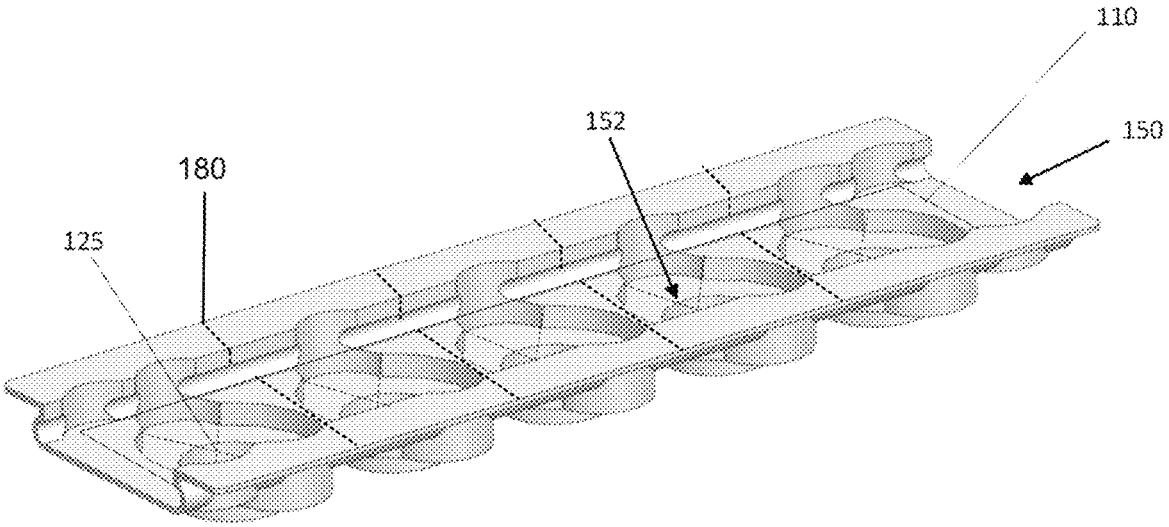
FIG. 8 is a top perspective view of a base and cover, in an assembled form, according to another aspect of the invention.

In an aspect, the base 150 can include at least one weakened section 180 between adjacent receptacles 151, as shown in FIG. 8. The base 150 can include two or more weakened sections 180. The weakened section 180 can extend from one side wall to another side wall of the base 150. The weakened section 180 can be in a form, such as perforations in the material, that can allow a user to break away a single receptacle 151 from an adjacent receptacle 151.

In an aspect, a cover 110 can be present on each receptacle 151 and can also include a weakened section 125 in the cover 110 that corresponds with an underlying weakened section 180 in the base 150. In this manner, a package 100 can be a base 150 including a single receptacle 151 with a single cover 110. A user could break off the single package 100 from a length of a plurality of packages 100. For example, the package 100 can be placed in a dispenser and each receptacle 151 can be torn from its adjacent receptacle 151 when a single product in the package 100 is needed.

Figure 9:
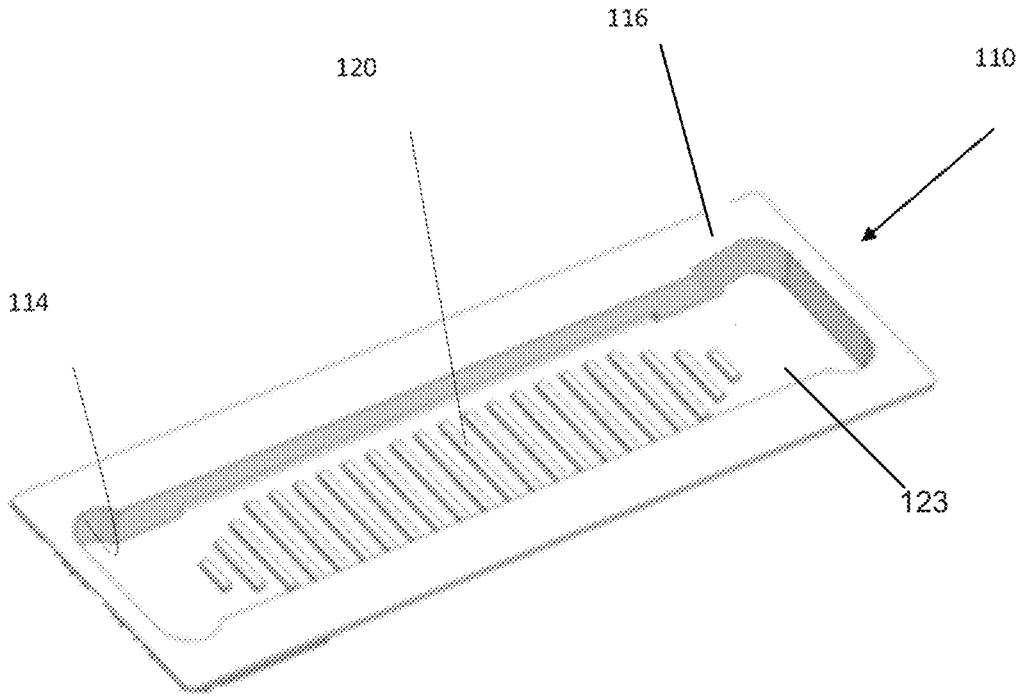
FIG. 9 is a top perspective view of a cover, according to an aspect of the invention.
Figure 10:
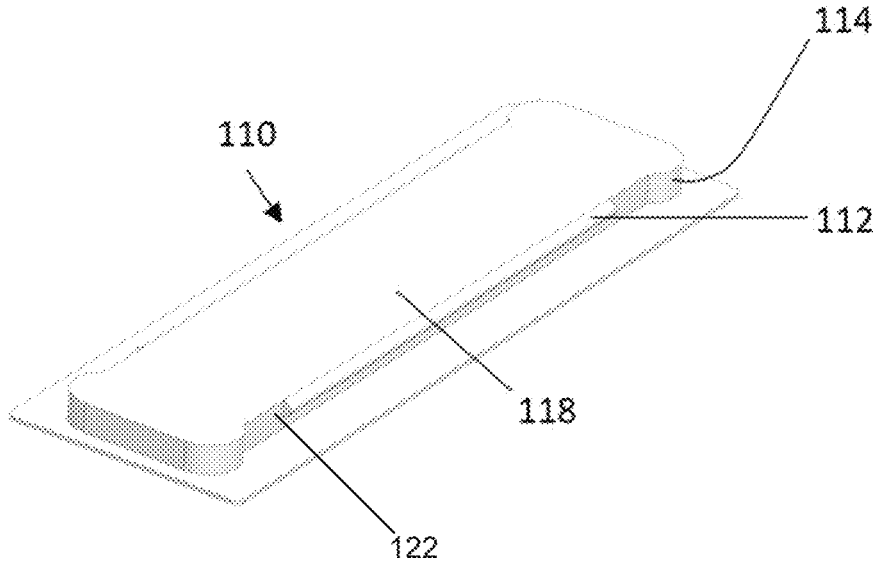
FIG. 10 is a bottom perspective view of a cover, according to another aspect of the invention.

FIGS. 9 and 10 illustrates a cover 110, which is a single cover including a top surface 116 and a bottom surface 118 (shown in FIG. 10). The cover 110 can include an area 123 that is recessed relative to a top plane of the top surface 116 cover 110, so that the recessed area forms the bottom surface 118 of the cover. At least a portion of the top surface 116 can include a surface texture 120. In an example, the surface texture 120 can be in a form chosen from ridges, recesses, cavities, lines, dots, holes, slits, particles, protrusions, indentations, inserted objects, or combinations thereof, in a random or non-random pattern. In an example, the surface texture 120 can form a shape of an arrow to suggest movement in one or both directions. In an aspect, the top surface 116 can be smooth.

Additionally, the cover 110 can include a first portion 112 and a second portion 114. The first portion 112 can be positioned on a side surface 122 of the cover adjacent to the bottom surface 118, as shown in FIG. 10. The first portion 112 can extend along at least a portion of the side surface 122. The cover 110 can include a first portion 112 on each side surface 122 of the recessed area 123. The second portion 114 can be located at an end of the recessed area 123. The cover 110 can include two second portions 114, one at each end of the recessed area 123. The first portion 112 and the second portion 114 can each be in a form of a recess, a protrusion, a slot, a rail, an indexing mechanism, or, etc.

In an aspect, a first portion 112 of the cover 110 can engage with the track 158 of the base 150. In an example, the track 158 can be a slot and the first portion 112 can be a rail or a protrusion that slidably connects with the slot. In another example, the track 158 can be a rail and the first portion 112 can a slit that can slidably connect to the track 158.

The second portion 114 of the cover 110 can engage with the lock 160 of the base 150. In an example, when the lock 160 is in a form of a recess, the second portion 114 can be a protrusion as shown in FIGS. 9 and 10. In another example, when the lock 160 is in a form of a protrusion, the second portion 114 can be a recess that can removably engage the lock 160 at a predetermined position. In an example, the second portion 114 can be in a form of an indexing mechanism. In an example, one end of the base 150 can be closed off such that the cover 110 can only slide out in one direction. In another example, both ends of the base 150 can be open and the cover 110 can slide out from either end.

In a further example, a fixing mechanism, such as a tape, can be applied to at least one of the base 150 and cover 110 to secure them together until a time of use. At the time of use, a user can remove the fixing mechanism, for example, cut the tape, to allow removal of the cover 110 from the base 150.

Figure 13A:
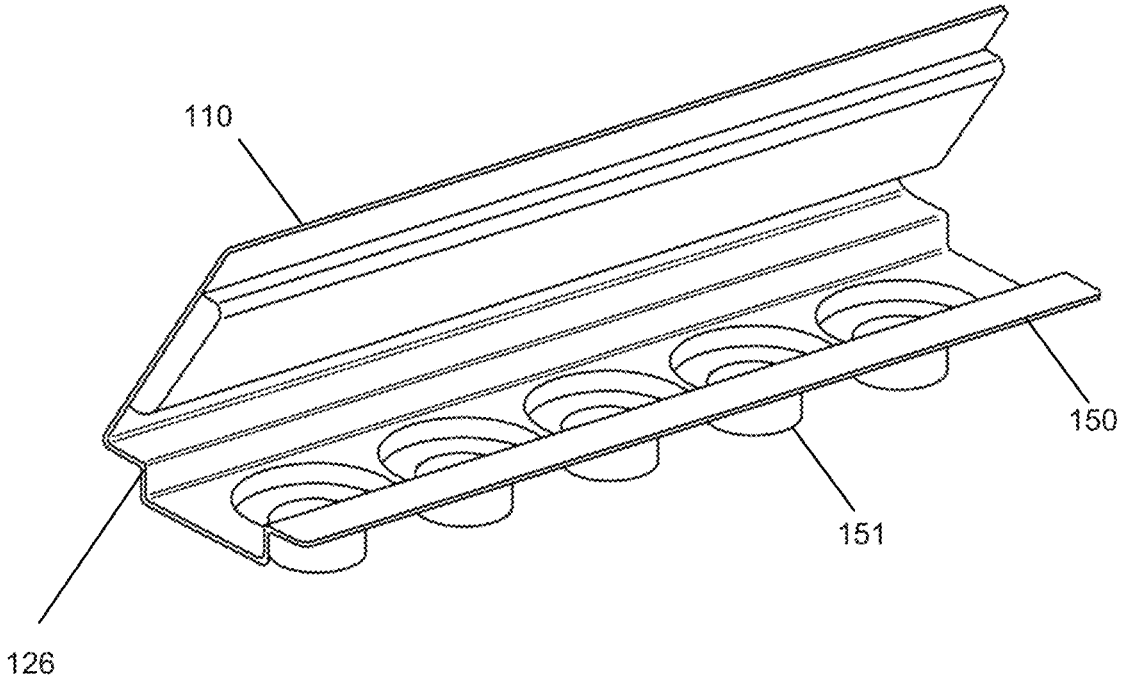
FIG. 13A is a view of a base attached to a cover by a hinge; according to an aspect of the invention.
Figure 13B:
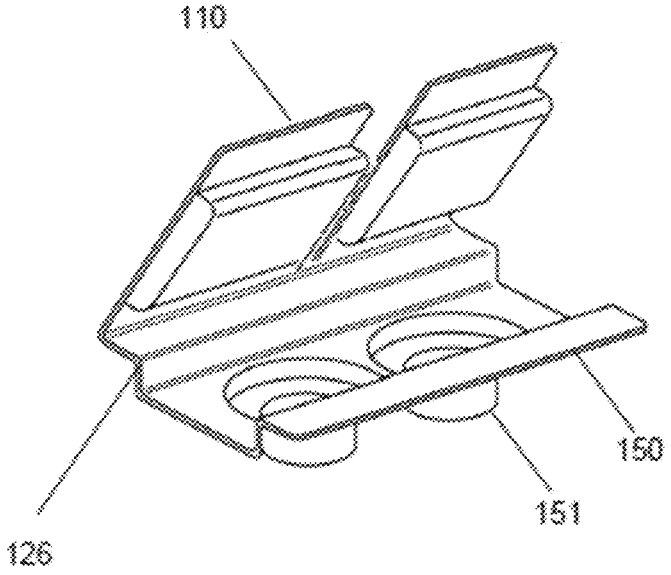
FIG. 13B is a view of a base attached to a plurality of covers by a plurality of hinges.

In another aspect, the base 150 can be attached to a cover 110 by at least one hinge 126, as shown in FIGS. 13A and 13B. The base 150 can be attached to the cover 110 by a single hinge 126 that extends along a length of an edge of the base 150, as shown in FIG. 13A. In another aspect, the base 150 can include a plurality of hinges, in which each hinge 126 can be positioned on an edge of the base and adjacent to a receptacle 151, and the cover 110 can be attached to the hinge 126. In this manner, a hinged cover 110 can be positioned adjacent to each receptacle. For example, as shown in FIG. 13B, a cover 110, such as a hinged cover 110, can correspond to each receptacle. In this manner, a single cover 110 corresponding to a single receptacle, such as a receptacle containing a product 172, can be opened at a time.

Figure 11:
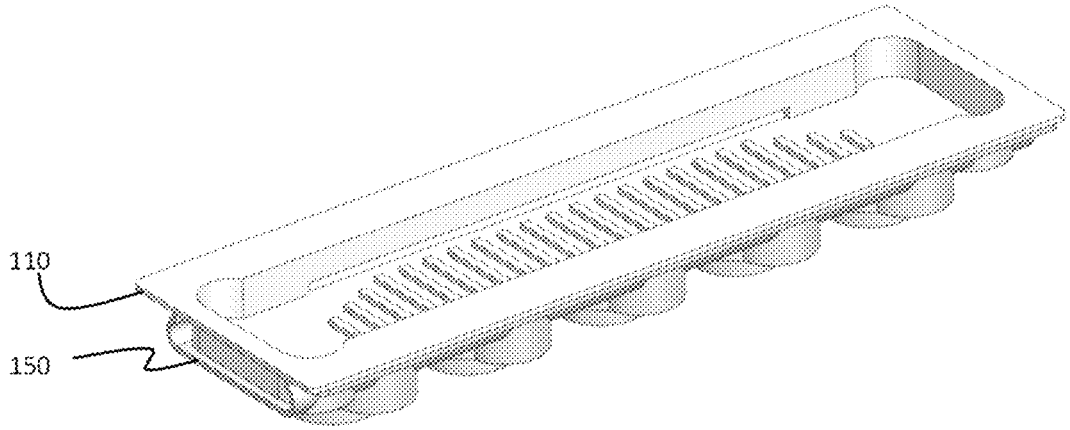
FIG. 11 is a top perspective view of a package including a cover and a base in a closed position, according to an example.

The base 150 and the cover 110 can be used to secure a product 172 into a receptacle 151. The cover 110 can protect the product 172 from contamination and accidental removal when the cover 110 is in a closed position. By a closed position, it is understood that the cover 110 is intact and positioned over an opening in the base 150 created by the receptacle 151. The second portion 114 can be positioned in the lock 160, as shown in FIG. 11. Alternatively, the cover 110, if it is a film, is intact and positioned over the opening without any breakage of any weakened sections 125 or cut or score lines. The cover 110 can be placed in an open position. By an open position, it is understood that the cover is not intact and/or is not positioned over an opening in the base 150 created by the receptacle 151. As shown, in FIG. 12, the cover 110 is in an open position with respect to the first receptacle 151 and is in a closed position with respect to the second through the fourth receptacles.

The base 150 and the cover 110 can be made of a same material or a different material. The package 100 can be made from a material having a thickness ranging from about 0.01 mm to about 5 mm, such as about 0.01 mm to about 2 mm. Additionally, the package 100 can include a height of from 1 mm to 100 mm or more, such as a height of from about 3 mm to about 20 mm, or 5 mm to about 20 mm, or 11 mm. A length of the package 100 can be variable depending on the number of receptacles 151 in the base 150. In an example, the length of the package 100 can be from about 10 mm to about 5000 mm or more, such as from about 20 mm to about 500 mm. The width of the package 100 can be from about 1 mm to about 100 mm or more, such as from about 5 mm to about 100 mm, such as from about 10 mm to about 30 mm. For example, if a customer is interested in purchasing fifty pieces of a product 172, such as a frit, the base 150 can include a length that encompasses fifty receptacles 151 and/or a cover 110 that protects all fifty pieces of product 172 either individually or collectively.

As another example, the package 100 can include a base 150 having an array of receptacles 151 in which each receptacle 151 can be separated from another by a weakened section, such as perforations in the base 150. The array can be 10 receptacles wide by 5 receptacles long, as an example. In this manner, a user can tear or break a single receptacle 151 away from a plurality of receptacles. A cover 100 can be a plurality of covers that are separated one from another by a weakened section. In this manner, a cover 100 can remain with each receptacle 151 of the base 150 after separation from the plurality of receptacles 151 and plurality of covers 100.

The product 172 can be a single item or a plurality of items, such as a filter assembly, a frit, or a guard column assembly. The product 172 can be fixed to each other or loosely placed in the container portion 152 of the receptacle 151. The product 172 can include a height that is the same or different from the height H1 of the container portion 152. For example, the height of the product 72 can be as high as the sum of the height H1 and H2.

One example of a method for installing the product 172 from the package 100 will now be described with the understanding that the example does not limit the broadest aspects of the subject matter disclosed herein. The package 100 can be configured according to any of the aspects disclosed herein. The package 100 can include at least one product 172 stored in the container portion 152 of at least one receptacle 151 of the base 150. The package 100 can be initially provided to a user in a closed position in which the cover 110 is intact and positioned over an opening in the base 150 over the receptacle 151.

To remove the product 172 from the package 100, a method can include moving a cover 100 from a closed position to an open position; inserting a fitting 190 into a received portion 150 of a receptacle 151 of a base 150; applying a force to the container portion 152; and removing the fitting from the receiver portion 154 of the receptacle 151. The applied force can cause the container portion 152 to a least partially or temporarily deform. The at least partial or temporarily deformation of the container portion 152 provides a confirmation that a product 172 is placed in the fitting 190. The confirmation can be acoustic and/or haptic feedback. Alternatively, the applied force can be a tilting of the package 100 and inserted fitting 190, so that the product 172 can slide, due to the tilt, out of the container portion 152 and onto the fitting 190. The method will be further explained below.

Figure 12:
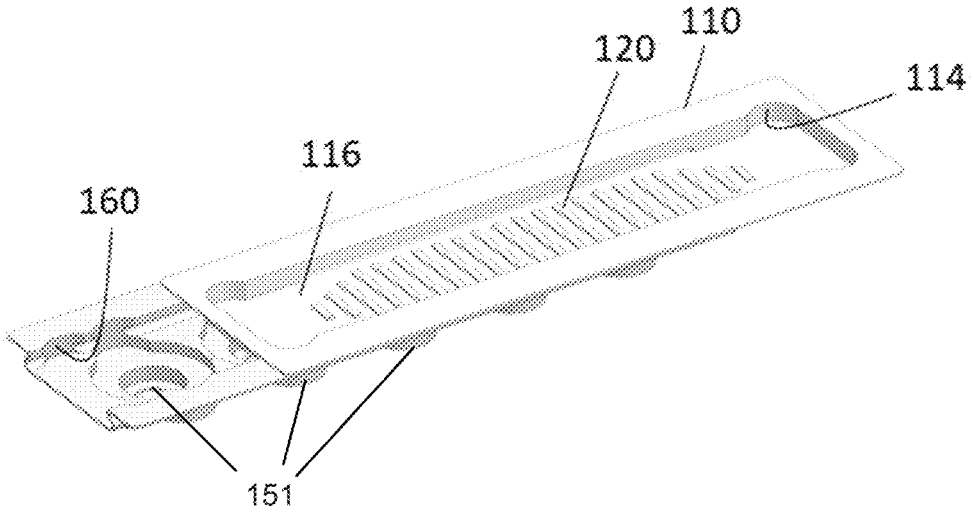
FIG. 12 is a top perspective view of FIG. 11, in a partial open position, according to an example.

In an aspect, a user can partially remove the cover 110 from the closed position to an open position by pushing on the surface texture 120 of the cover 110 to slide the cover 110 away from the first receptacle 151 of the plurality of receptacles (as shown in FIG. 12). Alternatively, the cover 110 can be a peelable film over the first receptacle 151, which can be removed. At the open position, the fitting 190 can be inserted into a receiver portion 154 of the receptacle 151, such that the product 172 stored in the container portion 152 is aligned with an opening of the fitting 190. The product 172 can be subsequently moved into the opening of the fitting 190 by applying a force to the container portion 152. In this manner, the product 172 can be removed without contacting anything other than the receptacle 151 and the fitting 190.

After insertion of the product 172, the user can then remove the fitting 190 from the receiver portion 154. In an example, the user can place the fitting 190 on top of the receiver portion 154, and then flip over both the fitting 190 and the receiver portion 154 to release the product 172 into the opening of the fitting 190. In another example, the user can simply tilt the fitting 190 and the base 150 such that the gravity force pulls the product 172 from the container portion 152 into the opening of the fitting 190.

In another example, the product 172 can be friction fitted into the container portion 152, and as such, the user can need to push the product 172 into the opening of the fitting 190. This example can have the benefit of the user hearing a confirmation sound, such as a click, caused by the collapse of the container portion 152 as the user presses on the container portion 152 to push the product into the space of the opening of the fitting. By collapsing the container portion 152, the user cannot place another product 172 back into the already collapsed container portion 152. This can eliminate the risk of used fits being mixed up with new ones in the remaining container portion 152.

In another example, the container portion 152 can be made of a deformable material that can spring back to its original form after being collapsed to push the product out. In this example, the user will hear a second confirmation sound indicating that the user can now remove the package 100 from the fitting 190.

Figure 16:
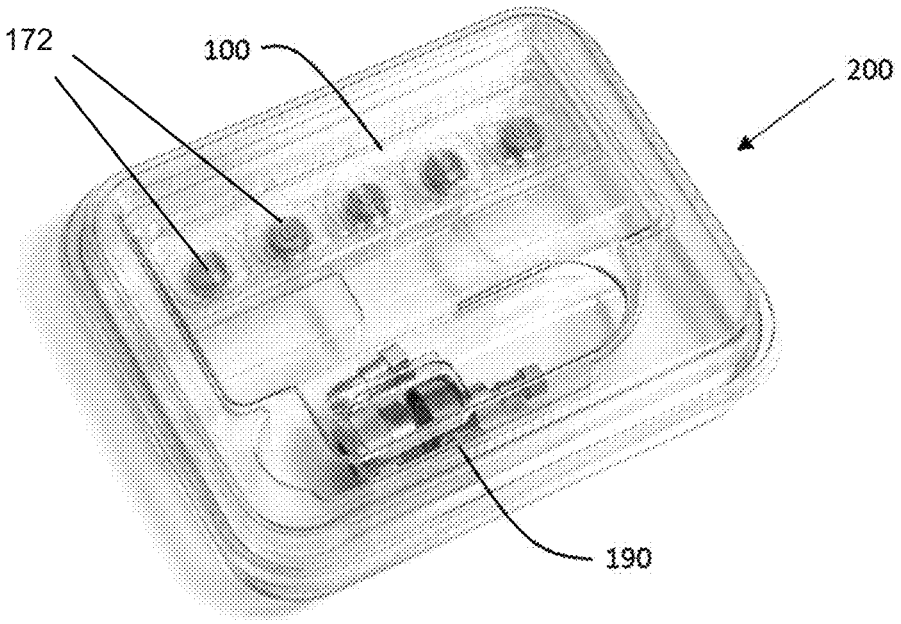
FIG. 16 is a top perspective view of a kit, including a package, a fitting, and a plurality of products within the package, according to an example.

FIG. 16 is a top perspective view of a kit, including a package 100, a fitting, and a product 172. The kit 200 can be defined by a structural framework capable of holding and protecting the package 100 to be used. The kit 200 can include a lid movable relatively to a body, and the lid and the body can be configured in a manner such that the kit 200 can be closed in a substantially leak-tight manner. The kit 200 can further have a first container releasably fitted with the package 100 and a second container releasably fitted with the fitting 190. The product 172 can be releasably fitted within the package 100. The framework can be made optionally as a single piece, and can be made of suitable structural material, including stainless steel, alloys, composite plastics, or any other suitably engineered material. In an example, the framework can be made of transparent plastics.

This disclosure is to be broadly construed. It is intended that this disclosure disclose equivalents, means, systems and methods to achieve the devices, activities and mechanical actions disclosed herein. For each device, article, method, mean, mechanical element or mechanism disclosed, it is intended that this disclosure also encompasses in its disclosure and teaches equivalents, means, systems and methods for practicing the many aspects, mechanisms and devices disclosed herein. Additionally, this disclosure is intended to encompass the equivalents, means, systems, and methods of the use of the device and/or article of manufacture and its many aspects consistent with the description and spirit of the operations and functions disclosed herein. The claims of this application are likewise to be broadly construed.

The description of the inventions herein in their many embodiments is merely exemplary in nature and, thus, variations that do not depart from the gist of the invention are intended to be within the scope of the invention. Such variations are not to be regarded as a departure from the spirit and scope of the invention.

We claim:

1. A package, comprising:

a base having at least one receptacle, wherein the at least one receptacle includes a container portion having a second diameter (D2) and a first height (H1), and a receiver portion having a first diameter (D1) and a second height (H2), wherein the receiver portion includes a first receiver portion including the first diameter (D1), wherein the receiver portion includes oppositely disposed symmetrical bulge portions adjacent to the first receiver portion, and wherein the base includes a lock extending from and formed as part of each of the oppositely disposed symmetrical bulge portions.

2. The package of claim 1, wherein the first diameter (D1) is larger than the second diameter (D2).

3. The package of claim 1, further comprising an identifier chosen from an RFID, a QR code, a pin, a word, a color, a symbol, an alphanumeric, an indicium, or a part number.

4. The package of claim 1, further comprising at least one cover.

5. The package of claim 4, wherein the at least one cover is a film, a hinged cover, or a slidable cover.

6. The package of claim 4, wherein the at least one cover is a single cover including a first portion and a second portion, wherein the first portion and the second portion are each in a form of a rail, a protrusion, a recess, or an indexing mechanism.

7. The package of claim 4, wherein at least a portion of a top surface of the at least one cover includes a surface texture in a form of ridges, recesses, cavities, lines, dots, holes, slits, particles, protrusions, indentations, inserted objects, or combinations thereof, in a random or non-random pattern.

8. The package of claim 1, wherein the at least one receptacle is formed of a deformable material.

9. The package of claim 1, wherein the at least one receptacle includes a ledge.

10. The package of claim 1, wherein the lock includes a partial bulge-shaped configuration.

11. A package, comprising:

a base having a plurality of adjacently disposed receptacles, wherein at least two receptacles of the plurality of adjacently disposed receptacles include a container portion having a second diameter (D2) and a first height (H1), and a receiver portion having a first diameter (D1) and a second height (H2), wherein the receiver portion includes oppositely disposed bulge portions, wherein the base includes a track that extends along a length of a side of the base and along an edge of the plurality of adjacently disposed receptacles, and wherein the base includes at least one lock extending from the oppositely disposed bulge portions.

12. A package, comprising:

at least two receptacles;

a base having the at least two receptacles;

a lock disposed on the base, wherein the base includes the lock adjacent to a bulge portion of a receptacle of the at least two receptacles that is disposed adjacent to an edge of the base, wherein each receptacle of the at least two receptacles includes an upper receiver portion of a larger diameter and a lower container portion of a smaller diameter, and wherein the lower container portion includes a ledge protruding inwardly from an inner surface and a relatively flat outer surface in a vicinity of the ledge.

* * * * *